United States Patent [19]

Nakamura

[11] Patent Number: 4,882,813

[45] Date of Patent: Nov. 28, 1989

[54] BANDING CLIP

[75] Inventor: Toshinobu Nakamura, Tokyo, Japan

[73] Assignee: Shinagawa Shoko Co., Ltd., Tokyo, Japan

[21] Appl. No.: 265,095

[22] Filed: Oct. 31, 1988

[30] Foreign Application Priority Data

Nov. 18, 1987 [JP] Japan ..... 62-175063

[51] Int. Cl.[4] ..... B65D 63/00

[52] U.S. Cl. ..... 24/16 PB; 24/17 AP

[58] Field of Search ..... 24/16 PB, 16 R, 17 A, 24/17 AP, 30.5 P, 269

[56] References Cited

U.S. PATENT DOCUMENTS

| | | | |
|---|---|---|---|
| 3,653,099 | 4/1972 | Hoffman | 24/16 PB |
| 3,816,879 | 6/1974 | Merser et al. | 24/16 PB |
| 3,909,884 | 10/1975 | Weckesser | 24/16 PB |
| 4,377,887 | 3/1983 | Valestin | 24/16 PB |
| 4,574,434 | 3/1986 | Shupe et al. | 24/16 PB |

FOREIGN PATENT DOCUMENTS

| | | | |
|---|---|---|---|
| 1123839 | 9/1956 | France | 24/16 PB |
| 43-28419 | 11/1968 | Japan . | |
| 44-14895 | 6/1969 | Japan . | |
| 46-27628 | 9/1971 | Japan . | |
| 48-30424 | 9/1973 | Japan . | |
| 52-10518 | 3/1977 | Japan . | |
| 52-10520 | 3/1977 | Japan . | |
| 52-10521 | 3/1977 | Japan . | |
| 52-32284 | 7/1977 | Japan . | |
| 53-6586 | 2/1978 | Japan . | |
| 53-15450 | 4/1978 | Japan . | |
| 54-41766 | 12/1979 | Japan . | |
| 62-27131 | 7/1987 | Japan . | |
| 2063354 | 6/1981 | United Kingdom | 24/16 PB |

*Primary Examiner*—Victor N. Sakran

*Attorney, Agent, or Firm*—Fidelman & Wolffe

[57] ABSTRACT

A banding clip for holding an article with an elongated band, comprising first band engaging member for engaging one end portion of the band, first guiding member for guiding engagement of the one end portion of the band with the first band engaging member, second band engaging member for engaging any portion other than the one end portion of the band, and second guiding member for guiding engagement of the any portion of the band with the second band engaging member, wherein the band is formed independently of the banding clip and has a plurality of teeth on one entire surface thereof adapted to engage the first band engaging member and the second band engaging member.

11 Claims, 5 Drawing Sheets

BANDING CLIP

BACKGROUND OF THE INVENTION

The present invention relates to a banding clip for holding an article such as cables, telephone post, box or bag with an elongated band, and more particularly to a banding clip with a band adapted to be unreleaseably engaged with the clip once the article has been held thereby.

FIGS. 1 and 2 show a conventional banding clip including a clip body (a) and a band (b) integrally formed with the clip body (a). The clip body (a) and the band (b) are formed of a synthetic resin material or the like. The band (b) is formed at its free end portion with a toothed portion (c) adapted to be engaged with a pawl (d) formed in the clip body (a).

In the conventional banding clip as mentioned above, it is necessary to prepare many kinds of the bands (b) having different lengths according to various applications, that it, different sizes of the articles, and accordingly, it is necessary to manufacture many kinds of the banding clips including the many kinds of the bands (b). At present, any of these many kinds of the banding clips is selected according to a desired application.

Further, as the band (b) is integrally formed with the clip body (a), the length of the band (b) permitted to be manufactured is limited in consideration of a permissible length of a molding. Therefore, a long band (b) capable of holding an article having a large size cannot be manufactured.

SUMMARY OF THE INVENTION

It is a first object of the present invention to provide a banding clip with a band which may hold a variety of articles having different sizes, particularly an article having a large diameter.

It is a second object of the present invention to provide a banding clip with a band which may be manufactured at low costs.

It is a third object of the present invention to provide a banding clip with a band which is easy and speedy to operate.

According to the present invention, there is provided a banding clip for holding an article with an elongated band, comprising first band engaging means for engaging one end portion of said band, first guiding means for guiding engagement of said one end portion of said band with said first band engaging means, second band engaging means for engaging any portion other than said one end portion of said band, and second guiding means for guiding engagement of said any portion of said band with said second band engaging means, said band being formed independently of said banding clip and having a plurality of teeth on one entire surface thereof adapted to engage said first band engaging means and said second band engaging means.

In operation, the band is preliminarily cut into a desired length of band piece in accordance with a size of the article to be surrounded by the band piece. Then, an end portion of the band piece is inserted from an end opening of the clip through a first gap defined between the first band engaging means and the first guiding means as being guided by the first guiding means. Accordingly, the teeth of the band piece are brought into engagement with teeth of the first band engaging means. Thereafter, the article is surrounded by the band piece, and the other end portin of the band piece is inserted from another end opening of the clip through a second gap defined between the second band engaging means and the second guiding means as being guided by the second guiding means. Then, the other end portion of the band piece is drawn out of the second gap until the article is firmly tightened by the loop of the band piece. Accordingly, the teeth of the band piece are brought into engagement with teeth of the second band engaging means.

Other objects and features of the invention will be more fully understood from the following detailed description and appended claims when taken with the accompanying drawings.

DETAILED DESCRIPTION OF THE PREFERRED EMBODIMENTS

Figure 6:
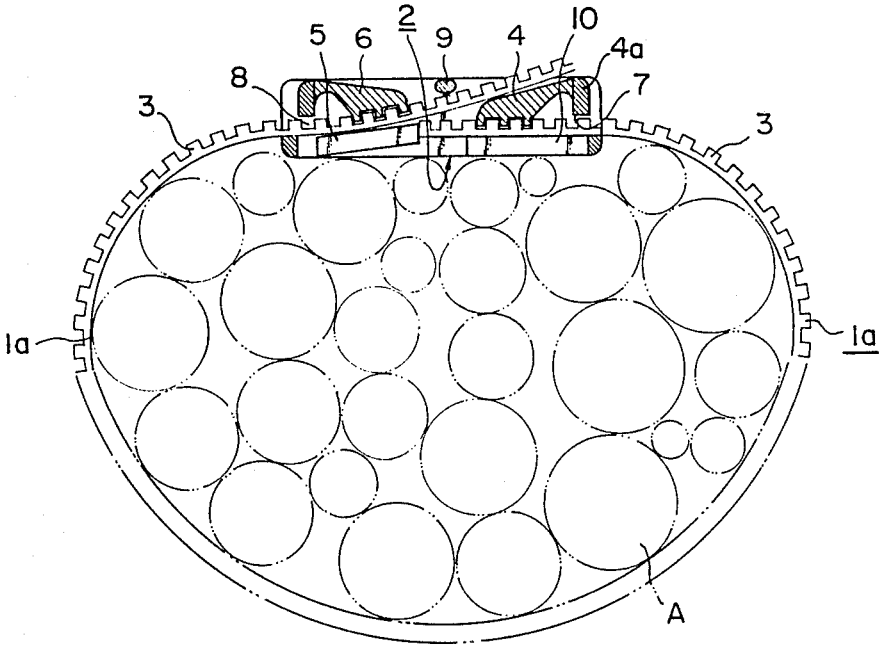
FIG. 6 is an illustration, in side section of the operation of the first preferred embodiment.

Referring now to FIGS. 3 to 6 which show a first preferred embodiment of the present invention, reference numeral 1 designates an elongated band having on its one entire surface with a plurality of teeth 3 each having a rectangular cross section. Reference numeral 2 generally designates a banding clip adapted to be used with the elongated band 1, so as to hold an article A such as cables as shown in FIG. 6. The elongated band 1 and the banding clip 2 are formed of a flexible synthetic resin material, and they are formed independently.

Figure 1:
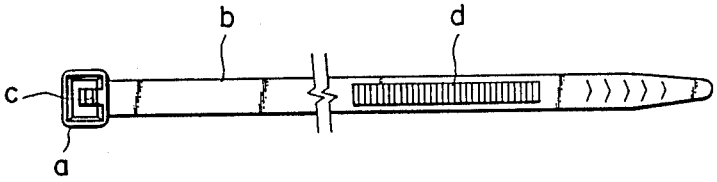
FIG. 1 PRIOR ART
FIG. 1 is a plan view of a conventional banding clip.
Figure 2:
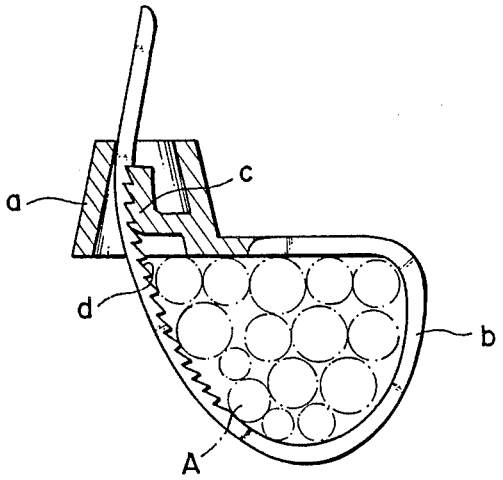
FIG. 2 PRIOR ART
FIG. 2 is an illustration, in side section, of the operation of the banding clip shown in FIG. 1.
Figure 3:
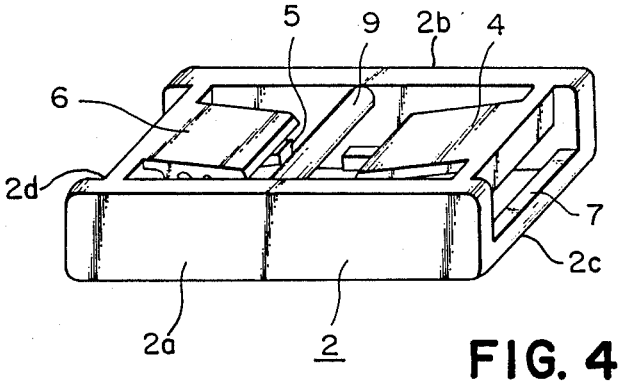
FIG. 3 is a perspective view of the banding clip of a first preferred embodiment of the present invention.
Figure 4:
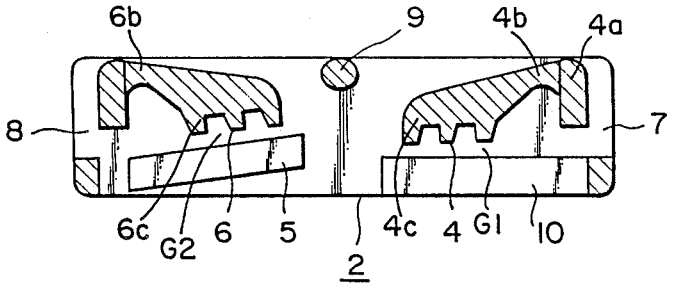
FIG. 4 is a cross section taken along the line IV—IV in FIG. 3.
Figure 5:
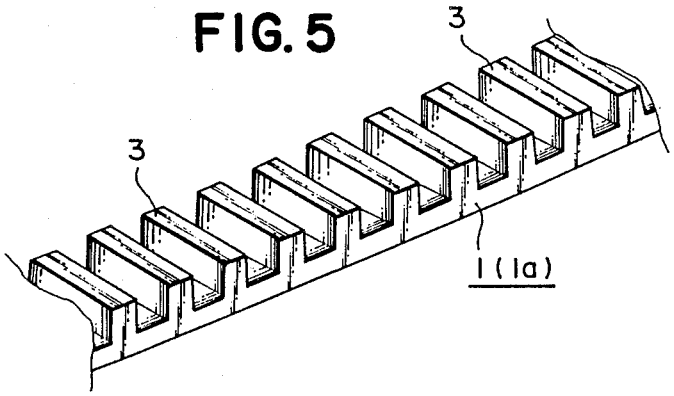
FIG. 5 is an enlarged perspective view of the band, partly broken away.

As shown in FIGS. 3 and 4, the banding clip 2 has a general shape of rectangular prism having substantially parallel opposite side walls 2*a* and 2*b*. The side walls 2*a* and 2*b* are connected with each other by a pair of transverse portions 2*c* and 2*d* formed at opposite ends of the banding clip 2.

Reference numerals 4 and 6 designate first and second band engaging members, respectively, adapted to engage the band 1. The first band engaging member 4 is formed between the side walls 2*a* and 2*b* at one end portion of the banding clip 2, and the second band engaging member 6 is formed between the side walls 2*a* and 2*b* at the other end portion of the banding clip 2. The first band engaging member 4 is constituted of a base portion 4*a* extending transversely between the side walls 2*a* and 2*b*, a toothed pawl portion 4*c* extending inwardly longitudinally of the banding clip 2 in a pent roof fashion, and a neck portion 4*b* formed between the base portion 4*a* and the toothed pawl portion 4*c*. The base portion 4*a* is disposed in substantially parallel relationship to the transverse portion 2*c* to define a first opening 7 for inserting the band 1 therethrough. The neck portion 4*b* has a relatively thin wall to permit elastic deformation thereof. The toothed pawl portion 4*c* is formed at its lower surface with a plurality of teeth adapted to engage the teeth 3 of the band 1, and is formed with an upper surface inclined downwardly inwardly of the banding clip 2.

Similarly, the second band engaging member 6 is constituted of a base portion 6*a* extending transversely between the side walls 2*a* and 2*b*, a toothed pawl portion 6*c* extending inwardly longitudinally of the banding clip 2 in a pent roof fashion, and a neck portion 6*b* formed between the base portion 6*a* and the toothed pawl portion 6*c*. The base portion 6*a* is disposed in substantially parallel relationship to the transverse portion 2*d* to define a second opening 8 for inserting the band 1 therethrough. The neck portion 6*b* has a relatively thin wall to permit elastic deformation thereof. The toothed pawl portion 6*c* is formed at its lower surface with a plurality of teeth adapted to engage the teeth 3 of the band 1, and is formed with an upper surface inclined downwardly inwardly of the banding clip 2.

Reference numerals 10 and 5 designate first and second guiding members for guiding engagement of the band 1 with the first and second band engaging members 4 and 6, respectively. The first guiding member 10 is constituted of a pair of elongated projections formed on the inside surfaces of the side walls 2*a* and 2*b* in such a manner as to extend in substantially parallel relationship to the lower surfaces of the side walls 2*a* and 2*b*, respectively. Thus, there is defined a first gap G1 between the teeth of the toothed pawl portion 4*c* and the upper surfaces of the elongated projections of first guide member 10 so that a thickness of the band 1 may be inserted through the first gap G1 against the resilient force of the neck portion 4*b* of the first band engaging member 4.

Similarly, the second guiding member 5 is constituted of a pair of elongated projections formed on the inside surfaces of the side walls 2*a* and 2*b* in such a manner as to extend in inclined relationship to the lower surfaces of the side walls 2*a* and 2*b*, respectively. The elongated projections have respective upper surfaces substantially parallel to the teeth of the toothed portion 6*c* of the second band engaging member 6, thus defining a second gap G2 between the teeth $6c_1$ and the upper surfaces of the elongated projections of second guide member 5 so that the band 1 may be inserted through the second gap G2 against the resilient force of the neck portion 6*b* of the second band engaging member 6. The elongated projections of the elongated projections of second guide member 5 each have respective end surfaces which serve serving as a stopper surface adapted to abut against a leading end of the band 1 inserted through the first gap G1 as shown in FIG. 6. Reference numeral 9 designates a guide bar formed transversely between the side walls 2*a* and 2*b* at an intermediate position between the first and second band engaging members 4 and 6 for guiding the band 1 drawn out of the second gap G2 in cooperation with the upper inclined surface of the toothed pawl portion 4*c* of the first band engaging member 4.

In operation, the band 1 is preliminarily cut into a desired length of band piece 1*a* in accordance with a size of the article A to be surrounded by the band piece 1*a* as shown in FIG. 6. Then, an end portion of the band piece 1*a* is inserted from the first opening 7 through the first gap G1 as being guided by the transverse portion 2*c* and the first guide member 10 until the leading end of the band piece 1*a* abuts against the end surface of the elongated projections of second guide member 5. Accordingly, the teeth 3 of the band piece 1*a* are brought into engagement with the teeth of the toothed pawl portion 4*c* of the first band engaging member 4. Thereafter, the article A is surrounded by the band piece 1*a*, and the other end portion of the band piece 1*a* is inserted from the second opening 8 through the second gap G2 as being guided by the transverse portion 2*d* and the second guide member 5. Then, the other end portion of the band piece 1*a* is drawn out of the second gap G2 as being guided by the guide bar 9 and the inclined upper surface of the toothed portion 4*c* of the first band engaging member 4 until the article A is firmly tightened by the loop of the band piece 1*a*. Accordingly, the teeth 3 of the band piece 1*a* are brought into engagement with the teeth of the toothed portion 6*c* of the second band engaging member 6. The engagement between the teeth 3 of the band piece 1*a* and the teeth of the toothed portion 4*c* is enhanced by the resilient force of the neck portion 4*b* of the first band engaging member 4. Similarly, the engagement between the teeth 3 of the band piece 1*a* and the teeth of the toothed portion 6*c* is enhanced by the resilient force of the neck portion 6*b* of the second band engaging member 6.

Figure 7:
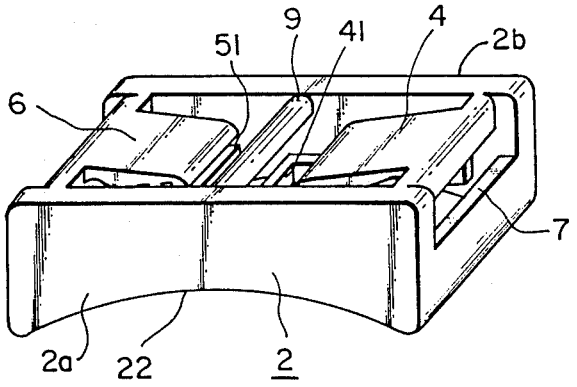
FIG. 7 is a perspective view of the banding clip of a second preferred embodiment of the present invention.
Figure 8:
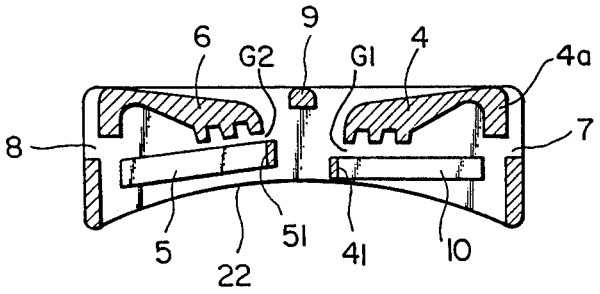
FIG. 8 is a cross section taken along the line VIII—VIII in FIG. 7.
Figure 9:
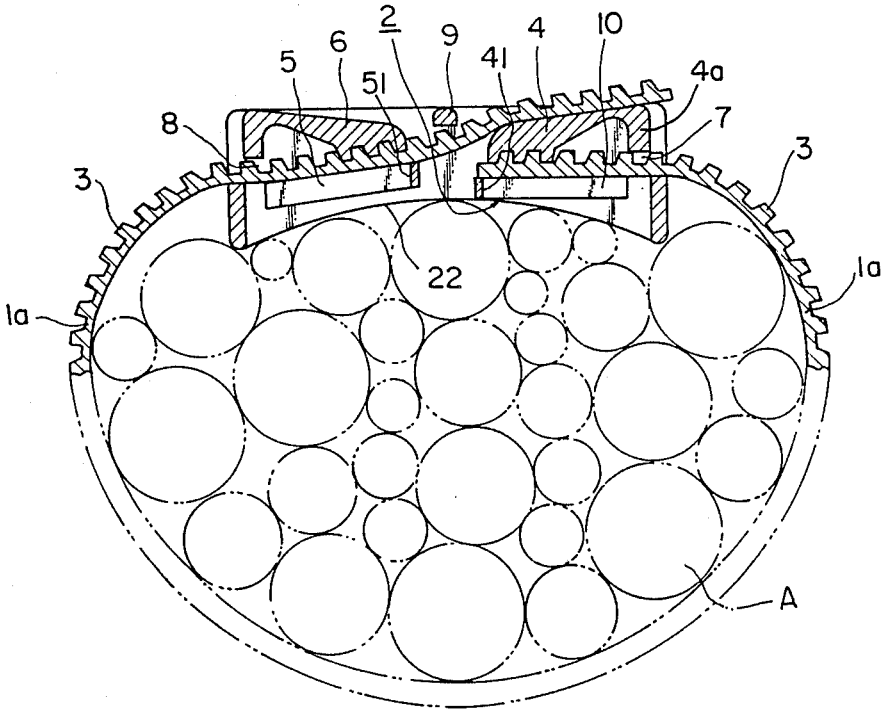
FIG. 9 is an illustration, in side section, of the operation of the second preferred embodiment.

Referring next to FIGS. 7 to 9 which show a second preferred embodiment of the present invention, the same parts as in the first preferred embodiment are designated by the same reference numerals, and explanation thereof will be omitted hereinafter. In the second prefered embodiment, the elongated projections of first guide member 10 are connected at their inward ends by a cross bar 41, and the elongated projections of second guide member 5 are similarly connected at their inward ends by a cross bar 51, so that the full width of the band piece 1*a* after inserted through the gaps G1 and G2 may be supported by the cross bars 41 and 51, respectively. Further, the lower surfaces of the side walls 2*a* and 2*b* are formed into round surfaces 22 so that when the article A has a round outer surface, the round surfaces 22 of the banding clip 2 may be readily fitted to the article A upon firmly tightening the band piece 1*a*.

Although each of the teeth 3 of the band 1 has a rectangular cross section as mentioned in the preferred embodiments, the shape of each teeth 3 may be modified into various shapes such as a triangular cross section and a modified rectangular cross section.

Further, the structure of the first and second band engaging members and the first and second guiding members may be modified into any other structures permitting the engagement with the band and avoiding collision of the end portion of the band piece engaging the first band engaging member against the end portion of the band piece engaging the second band engaging member.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A banding clip for holding an article with an elongated band having a plurality of teeth on substantially one entire surface thereof, comprising:

first and second side walls which are spaced apart and which extend substantially parallel to each other;

first band engaging means for engaging one end portion of the band, said first band engaging means having a first base portion which extends between the first and second side walls;

first guiding means for guiding said one end portion of the band into engagement with said first band engaging means, said first guiding means comprising at least one projection which projects from at least one of said first and second side walls;

second band engaging means for engaging any portion other than said one end portion of the band, said second band engaging means having a second base portion which extends between the first and second side walls;

second guiding means for guiding said any portion of the band into engagement with said second band engaging means, said second guiding means comprising at least one projection which projects from at least one of said first and second side walls.

2. The banding clip as defined in claim 1, wherein a length of said elongated band is selectable according to a size of said article.

3. The banding clip as defined in claim 1, wherein said first band engaging means and said second band engaging means have a first toothed portion and a second toothed portion, respectively, adapted to engage said teeth of said band.

4. The banding clip as defined in claim 3, wherein said first toothed portion and said second toothed portion are disposed in substantially parallel relationship to said first guiding means and said second guiding means, respectively.

5. The banding clip as defined in claim 4, wherein a first gap is defined between said first toothed portion and said first guiding means for insertion of said one end portion of said band, and a second gap is defined between said second toothed portion and said second guiding means for insertion of said any portion of said band.

6. The banding clip as defined in claim 5, further comprising third guiding means for guiding a portion of said band drawn out of said second gap between said second toothed portion and said second guiding means, wherein said third guiding means comprises a bar which extends between said first and second side walls.

7. The banding clip as defined in claim 1, wherein said first and second band engaging means have a pent roof-like shape such that respective upper surfaces are inclined downwardly.

8. The banding clip as defined in claim 1, wherein said first guiding means extends in substantially parallel relationship to a lower surface of said side walls, and said second guiding means extends in inclined relationship to the lower surface of said side walls.

9. The banding clip as defined in claim 8, wherein said lower surface of said side walls is flat.

10. The banding clip as defined in claim 8, wherein said lower surface of said side walls is round.

11. The banding clip as defined in claim 1, wherein said first and second guiding means further comprise first and second cross bars extending between said side walls, respectively.

* * * * *